United States Patent [19]

Lussi et al.

[11] Patent Number: 4,794,020

[45] Date of Patent: Dec. 27, 1988

[54] PROCESS FOR MANUFACTURING INLAID TYPES OF SHEET MATERIALS

[75] Inventors: Edward F. Lussi, Bethelem, Pa.; Andrew J. Manning, Randolph, N.J.

[73] Assignee: Tarkett Inc., Parsippany, N.J.

[21] Appl. No.: 784,742

[22] Filed: Oct. 7, 1985

[51] Int. Cl.[4] ..... B05D 1/36; B05D 3/02; B05D 3/12; D06N 7/04

[52] U.S. Cl. ..... 427/195; 156/62.2; 427/202; 427/278; 427/366; 428/147

[58] Field of Search ..... 156/79, 62.2, 297, 277, 156/298, 390; 427/195, 278, 202–205, 365, 366; 428/147

[56] References Cited

U.S. PATENT DOCUMENTS 4,212,691 7/1980 Potosky et al. ..... 118/239 X
4,440,826 4/1984 Witman ..... 156/62.2

FOREIGN PATENT DOCUMENTS 1060282 8/1979 Canada .

*Primary Examiner*—Michael R. Lusignan

[57] ABSTRACT

An improved process, particularly adapted for making that type of sheet vinyl covering materials known as inlaids by first depositing resinous particles on a wet ungelled layer of PVC plastisol or organosol and then passing the sheet between a heated, cylindrical surface and a means for gradually and uniformly increasing the contact pressure between the cylindrical surface and the coated surface of the sheet. Upon completion of the step, a substantially uniformly, gelled matrix layer is produced, with the resinous particles embedded therein, and having a smooth and firm surface of uniform thickness.

17 Claims, 2 Drawing Sheets

PROCESS FOR MANUFACTURING INLAID TYPES OF SHEET MATERIALS

FIELD OF THE INVENTION

The present invention relates to a process for making sheet vinyl covering material in which it is desired to include chips or other particulate material. Such products are commonly referred to as inlaids and are characterized by their ability to maintain a decorative appearance as the surface is worn or abraded away. More particularly, this invention relates to a process for making sheet vinyl inlaids for use as floor or wall coverings.

BACKGROUND OF THE INVENTION

Inlaids are made either by embedding three-dimensional chips into a clear plastisol matrix or by compacting (or sintering) three-dimensional chips into a solid patterned mass. It is with the former processing technique that this invention is concerned. U.S. Pat. No. 4,212,691 and Canadian Pat. No. 1,060,282 are typical of prior art processes.

When three-dimensional particles are embedded in what is usually a thin layer of plastisol, it is difficult to produce the resultant embedded matrix with a smooth and uniform surface. Such a surface may be required, for example, to facilitate further processing and finishing. In the past, the production of a smooth, uniform surface has involved subsequent coating to smooth the embedded plastisol matrix and, optionally, the use of a rotating drum with back-up roller to compress and smooth the embedded plastisol matrix, either before or after coating.

When a subsequent coating of the completely gelled particle embedded plastisol is employed to smooth surface roughness, there is a tendency for air to become trapped under the coating and form visible bubbles which blemish the final product. The bubble formation occurs at the coatings' interface and is believed to be directly attributable to the surface roughness of the embedded plastisol matrix.

Also, when the particles used have one dimension significantly different from the other two dimensions, eg. flat or needle shaped particles, it is difficult to reduce the thickness of the coating/particle layer to less than the maximum dimension of a single particle. This is because embedding and smoothing by the prior art compression techniques discussed above results in random orientation of the embedded particles.

Processes using the above discussed embedding approaches generally require several steps to embed, gel and smooth the surface of the particle embedded coating. For example, in Canadian Pat. No. 1,060,282 the chips are applied to the wet, ungelled plastisol, which is then partially gelled and, thereafter, passed between a heated drum and a back-up roll to complete gelling and to smooth the surface of the coating. This patent also teaches that, where a clear wear layer is used over the layer containing the chips, it is preferred, prior to application of the wear layer, to smooth the plastic layer containing the chips, as by pressing the solidified, gelled layer against a roll.

U.S. Pat. No. 4,212,691 discloses depositing a substantially uniform layer of decorative chips upon a moving and vibrating substrate coated with an ungelled plastisol having a wet, tacky surface. The chips are deposited from a rolling bank of chips formed at a seal blade in contact with the surface. This is followed by a consolidation procedure, whereby the chips and the ungelled layer are compressed into a single layer and the ungelled plastisol transformed into a gelled plastisol. The consolidation procedure employs a large, steam-heated, rotatable, cylindrical drum having a plurality of heated, rotatable, pressure-applying cylindrical press rolls capable of applying pressure to any material placed on the surface of the heated, cylindrical drum.

The subject invention, which utilizes a novel technique for embedding particles in a plastisol coating while simultaneously gelling the plastisol/particle matrix layer, provides an improved process for producing inlaids. The invention capitalizes on and overcomes the inherent disadvantages of prior art embedding processes, such as those discussed above, and improves upon them by providing a novel means for smoothing the particle embedded plastisol layer while it is still in the fluid state. This improved process is uniquely suited for large scale, commercial production of sheet vinyl flooring and wall covering of the inlaid type, as well as other decorative inlaid types of sheet materials, particularly of the resilient type.

The process of this invention offers the specific advantages of providing, in one step, an inlaid matrix of uniform thickness, gelled throughout, with a firm and smooth surface. At the same time the process permits a lower coating/particle layer thickness (relative to particle size), denser particle loading and significantly improved orientation of flat or needle shaped particles.

BRIEF SUMMARY OF THE INVENTION

In accordance with this invention, there is provided an improvement in the method for making decorative inlaid types of sheet materials by forming a plastic layer of wet ungelled PVC plastisol or organosol on a sheet of flexible substrate and depositing resinous particles on said plastic layer. The improvement comprises the step of passing the sheet between a heated, cylindrical surface and a means for gradually and uniformly increasing the contact pressure between the cylindrical surface and the coated surface of the sheet. The sheet is passed with the coated side thereof in contact with the cylindrical surface.

The cylindrical surface in the usual case is in the form of a heated, rotating drum or other cylinder, preferably a heated chrome drum. The means for increasing the contact pressure, in the usual case is, preferably, a dimensionally stable belt under tension which surrounds part of the circumference of said cylindrical surface.

The pass is carried out at a temperature sufficient to gel the plastisol. Upon completion of the step, a substantially uniformly, gelled matrix layer is produced, with the resinous particles embedded therein, and having a smooth and firm surface of uniform thickness.

While it is not intended that the scope of this invention be limited by theory, it can be shown mathematically that the resultant normal force causing flow of the ungelled plastisol up around the resinous particles and toward the cylindrical surface increases, according to a sinusoidal function, from 0 to a maximum, occurring at the midpoint between the two points of contact (i.e. entry and exit points) between the cylindrical surface and the surface of the means for gradually increasing the pressure, this gradual increase in force results in gradual, even flow of the plastisol around the resinous particles toward contact of the cylinder surface without the formation of the rolling bank which occurs when pressure is applied by use of the nip rollers heretofore utilized by prior art inlaid production processes, such as those disclosed in the patents referred to above. The formation of such a rolling bank at the nip is undesirable when resinous particles are present on the surface to be compressed and gelled because redistribution of the resinous particles in a pattern commonly referred to as "tracking" occurs.

An important advantage of the improved process of this invention is the significant reduction in pressures needed for embedding and smoothing. Tension of the belt on the order of 5–50 pounds per lineal inch (pli) and, preferably, 10–25 pli can be employed. Although higher pressures can be used, the use of pressures within the above ranges permits the use of less massive equipment and the elimination of the high pressure nip rolls employed by the prior art embedding processes.

The resultant consolidated matrix does not require any further gelling. As it leaves the embedding/gelling/smoothing step, it is suitable for any additional processing or finishing as may be required by the product design being manufactured.

DESCRIPTION OF THE DRAWINGS

FIG. 2 is not drawn to scale and, therefor, is not intended to represent precise dimensional relationships. As shown, FIG. 2 is a portion of the unique embedding-/gelling/smoothing step, shown as Step 6 in FIG. 1, drawn to clearly illustrate the structure of the product layers as they appear before, during and after the step. In this view it is not intended that the thickness of the various layers be precisely represented. Rather, the various layers are represented on an illustrative scale which does not show precise relationships between thickness of the layers.

DETAILED DESCRIPTION OF THE INVENTION

Figure 1:
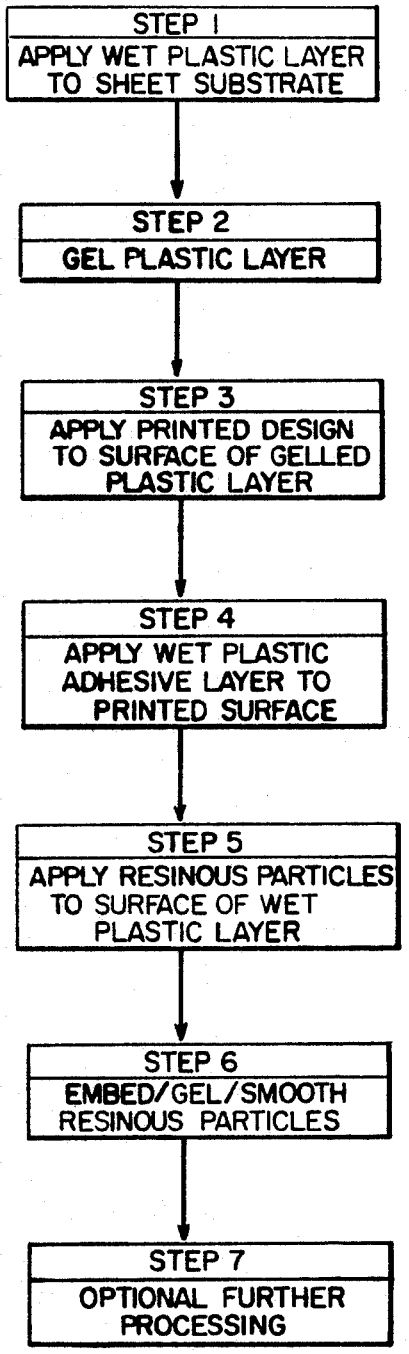
FIG. 1 is a flow sheet diagram representing a typical process of the invention for making sheet vinyl covering material. Step 6, the embedding/gelling/smoothing step, embodies the essence of this invention.
Figure 2:
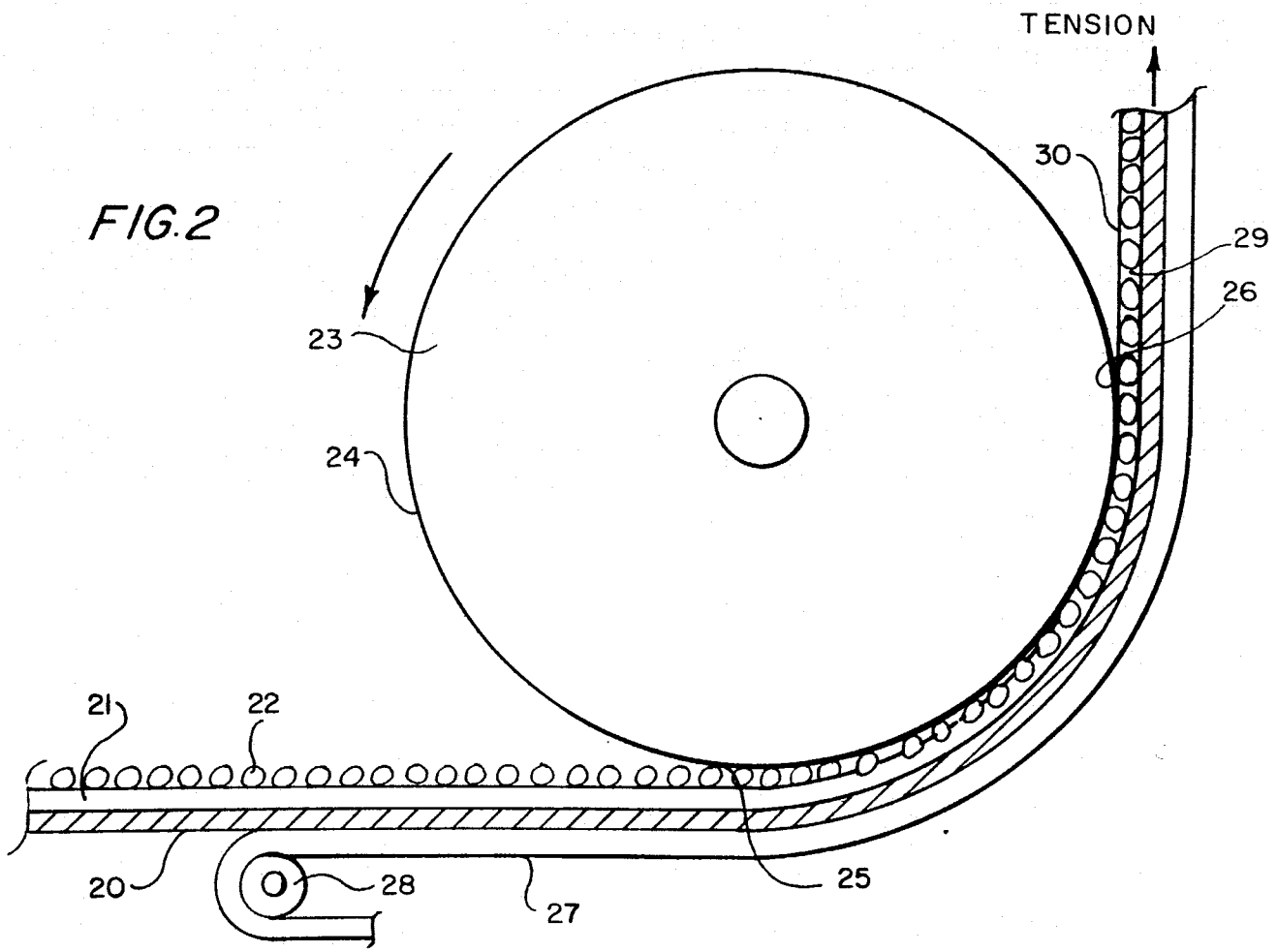
FIG. 2 is a fragmentary, diagrammatic, schematic view of a preferred embodiment for carrying out Step 6 of FIG. 1.

FIG. 2 illustrates diagrammatically the essence of the invention, the embedding/gelling/smoothing operation (shown as Step 6 in FIG. 1). Referring to FIG. 2, the substrate 20, coated with an ungelled plastisol adhesive coat 21 with resinous particles 22 adhered to the surface thereof, is brought into contact with a rotating chrome drum 23, the surface 24 of which is at an elevated temperature, so that the particles 22 contact the drum. (The base material, optional coating(s) and optional print layer(s) of the substrate 20; the composition of the adhesive layer 21 and resinous particles 22, and methods for the application thereof are more fully discussed hereinafter.) The substrate 20 is brought into contact with rotating drum 23 by the application of mechanical force so that the resultant normal force, causing flow of the adhesive layer 21 up around the resinous particles 22 and toward the drum surface 24, increases according to a sinusoidal function from 0 to a maximum occurring substantially at the mid-point between the two points of contact 25 and 26 between the surface of the coated substrate 20 (ie. the resinous particles) and the surface 24 of the drum 23. As depicted in FIG. 2 the application of the required force is accomplished by use of a dimensionally stable belt 27 which is under tension caused by the application of force to idler roll 28. As the drum 23 rotates and the coated substrate 20 moves in contact with the heated surface 24 at the gradually increasing contact pressures herein described, chemical/physical transformations are triggered which result in at least three desirable phenomena: (i) the resinous particles 22 become embedded in the adhesive layer 21 and form a matrix 29 of substantially uniform thickness, (ii) the matrix 29 is gelled and (iii) the surface 30 of the matrix 29 becomes smooth and firm. This embedding/gelling/-smoothing step is discussed more fully hereinafter.

The invention will now be described with reference to the process shown in the process flow diagram of FIG. 1.

1. Substrate Coating Step

Substrate

The substrate is a relatively flat fibrous or non-fibrous backing sheet material, such as a fibrous, felted or matted, relatively flat sheet of overlapping, intersecting fibers, usually of non-asbestos origin. The substrate is preferably and typically supplied in roll form, where successive rolls may be joined together to form an essentially continuous sheet. The substrate can, if desired, be asbestos or non-asbestos felts or papers, woven or non-woven; knitted or otherwise fabricated textile material or fabrics comprised of cellulose, glass, natural or synthetic organic fibers, or natural or synthetic inorganic fibers, or supported or non-supported webs or sheets made therefrom or filled or unfilled thermoplastic or thermoset polymeric materials. While almost any flexible base substrate may be used, the preferred substrate is a sheet of felt or glass fiber matting.

These and other substrate or base materials are well known in the art and need not be further detailed here.

Substrate Coating

Although the use of a sealing or priming coat is not considered essential, it is preferred, especially where a glass fiber mat or certain felt bases materials are used.

Thus, the substrate or base material, optionally, can be coated to improve the print quality of the substrate. Such coatings can be plastisols, organosols, lacquers, filled or unfilled latex coatings, or other coatings conventionally employed as preprint sealants in the manufacture of floor or wall covering products.

As used herein, the term "plastisol" is intended to cover a relatively high molecular weight polyvinyl chloride (PVC) resin dispersed in one or more plasticizers. The plastisol, upon heating or curing, forms a tough plasticized solid. For purposes of the present invention plastisol compositions are intended to include organosols, which are similar dispersed polyvinyl chloride resin materials that, in addition, contain one or more volatile liquids that are driven off upon heating.

Those skilled in the art will appreciate that, in addition to the basic resin constituents, other commonly employed constituents can be present in the plastisol compositions in minor proportions. Such other constituents commonly include heat and light stabilizers, viscosity depressants, and/or pigments or dyes, the latter in order to contribute color to the polyvinyl chloride resin.

Typically the substrate coating employed in the process of this invention is a resinous polymer composition, preferably, a polyvinyl chloride plastisol which is substantially uniformly applied to the substrate surface, for example by means of a conventional knife coater or reverse roll coater. The particular means for applying the substrate coating to the surface of the substrate does not relate to the essence of the invention and any suitable coating means can be employed. Exemplary of other coating means are rotary screens, direct roll coaters, Meyer rod coaters and the like.

The thickness of the resinous polymer composition or plastisol, as it is applied to the surface of the substrate, is substantially uniform, and is in the range of about 3 mils to about 30 mils, 5 mils to about 10 mils being especially preferred. The substrate can be thinner or thicker as may be required by the particular product application.

Although the preferred and typical substrate coating is a polyvinyl chloride homopolymer resin, other vinyl chloride resins can be employed. Exemplary are a vinyl chloride-vinyl acetate copolymer (PVC/PVAc), a vinyl chloride-vinylidene chloride copolymer, and copolymers of vinyl chloride with other vinyl esters, such as, vinyl butyrate, vinyl propionate, and alkyl substituted vinyl esters, wherein the alkyl moiety preferably is lower alkyl containing between about 1–4 carbons. Other suitable synthetic resins such as polystyrene, substituted polystyrene, preferably wherein the substituents are selected from the group consisting of alkyl ($C_1$–$C_{10}$, usually $C_1$–$C_4$), aryl (preferably, $C_6$–$C_{14}$), polyolefins such as polyethylene and polypropylene, acrylates and methacrylates, polyamides, polyesters, and any other natural or synethetic resin capable of being applied to the substrate or base coatings of this invention to provide a smooth and uniform surface and/or to improve the print quality of the substrate or base coating surface, are also applicable; provided such resin is otherwise compatible with the overall product composition and, therefor, within the principles of this invention. Thus, it is not essential that a plastisol always be used. Organosols and aqueous latices (aquasols and hydrosols) are also of use, employing as the dispersing or suspending media, organic solvents and water, respectively, rather than plasticizers, as in the case of a plastisol.

Where the preferred plastisol is employed, typical of the the plasticizers which can be used are dibutyl sebacate, butyl benzyl sebacate, dibenzyl sebacate, dioctyl adipate, didecyl adipate, dibutyl phthlate, dioctyl phthlate, dibutoxy ethyl phthlate, butyl benzyl phthlate, dibenzyl phthlate, di(2-ethylhexyl) phthlate, alkyl or aryl modified phthalate esters, alkyl, aryl, or alkylaryl hydrocarbons, tricresyl phosphate, octyl diphenyl phosphate, dipropylene glycol dibenzoate, dibasic acid glycol esters, and the like. Other constituents of the resinous substrate coating can include a blowing or foaming agent such as azodicarbonamide (if a blowing or foaming procedure is desired), conventional stabilizers/accelerators, initiators, catalysts, etc., such as zinc oleate, dibasic lead phosphite, etc., conventional heat or light stabilizers, such as metallic soaps, etc., UV absorbers, colorants, dyes or pigments, notably, titanium oxide, solvents and diluents, such as methyl ethyl ketone, methyl isobutyl ketone, dodecyl benzene, etc., fillers, such as clay, limestone, etc, viscosity modifiers, antioxidants, bacteriostats and bacteriosides, and the like.

2. Gellation Step

After the substrate coating has been applied and adhered to the substrate, it is then heated in an oven, or other suitable heating apparatus, maintained at an elevated temperature of from about 240° F. to about 450° F., and preferably from about 260° F. to about 410° F., for a period of time of from about 1 minute to about 5 minutes, whereby it gels and becomes firm. The temperature and the time are interdependent; the higher the temperature, the shorter the time and vice versa. During this step the elevated temperature, however, is maintained below that point at which decomposition of any blowing or foaming agent which may have been included in the formulation of the substrate coating occurs.

3. Printing Step

The gelled substrate coating is then printed or coated, if so desired. Printing onto the substrate can be effected by rotogravure, flexigraphic, screen printing, or other printing techniques conventionally employed in making floor or wall covering products. Normally printing is effected by means of one or more suitably engraved printing rolls and associated back-up rolls. Compositions, thicknesses and methods used in applying these optional components may be as conventionally known in the art, including, for instance, but not limited to, those described in U.S. Pat. No. 3,458,337.

Print Layer and Inks

Suitable inks include those normally used in the manufacture of floor covering, preferably resilient floor covering. These include plastisol, solvent based systems and water based systems. Such systems can include a chemical suppressant in those cases where the substrate to which the ink is to be applied is a foamable plastisol or organosol. Such suppressants are well known in the art (eg. see U.S. Pat. No. 3,293,094).

4. Adhesive Layer Coating Step

The optionally printed, gelled coated substrate is then coated with a suitable wet PVC plastisol or organosol. The particular means used for applying the adhesive is not critical and any suitable device may be used. Exemplary are reverse roll coaters, knife-over-roll coaters or other similar devices.

Adhesive Layer

The adhesive layer is normally a plastisol or organosol additionally containing a plasticizer system, associated diluents, viscosity control aids and stabilizers. Those discussed above are exemplary. When underprinting is present, the adhesive would not normally contain colors or pigments which would render the adhesive layer opaque.

Although other homopolymers and copolymers of vinyl chloride, (ie. vinyl resins other than a plastisol or organosol) such as those discussed above, can also be employed, as a practical matter, current economics dictate the use of polyvinyl chloride plastisols of the type set forth in the examples hereinafter.

5. Particle Deposition Step

Decorative, resinous particles are next deposited onto the gelled, coated substrate with the ungelled adhesive top coating. Application can be by any suitable means which essentially uniformly deposits the particles onto the surface of the ungelled adhesive coating. This can be conveniently accomplished using a vibrating pan feeder device, such as the SYNTRON vibratory feeder made by FMC Corporation.

Resinous Particles

The resinous particles of this invention can be of various sizes and geometric shapes, spherical and essentially spherical, (sometimes referred to herein as "spheroidal") being one especially preferred shape. Each transluscent or opaque particle can contain its own individual colorant, dye or pigment, provided that at least some of the particles must be sufficiently transparent or sufficiently transluscent, to permit the printing on the print layer to show through. Discreet spheroidal particles provide enhanced visual effect of depth and improved wear characteristics. Illustrative of those spheroidal particles which are especially preferred are the particles and the methods for their manufacture taught in U.S. Pat. No. 3,856,900. This procedure is particularly convenient for the production of relatively small plastisol beads or "pearls" having a particle size of generally about 0.030 inch or smaller.

For similar particles and those ranging up to about 0.40 inch, these can be obtained by screening the oversized particles from normal suspension grade resin production or by making special particle sizes, for example, in accordance with U.S. Pat. No. 3,856,900. Particles in this size range are particularly useful for achieving certain desirable design effects. Such procedures are also capable of making smaller particle sizes, for example, ranging from about 0.015 inch to about 0.125 inch, (e.g. see U.S. Pat. No. 3,345,235), but in the case of spheroidal particles, the procedure of U.S. Pat. No. 3,856,900 is preferred.

Another particularly desirable shape are chips or flakes, characterized by one dimension being significantly smaller than the other two. For example, chips may range from 30 to 250 mils in the two larger dimensions and from 2 to 15 mils in thickness. Such chips or flakes also offer specific design effects. These materials are conveniently prepared from gelled plastisol sheets by grinding or chopping. These sheets are normally prepared by coating onto a release paper and gelling at conditions previously described in discussing the Gellation Step. Two typical and preferred chip formulations are:

Solid Chip Stock

| | Parts By Weight |
|---|---|
| PVC Homopolymer Dispersion Resin, RV = 3.0 | 55 |
| PVC Homopolymer Dispersion Resin, RV = 1.90 | 45 |
| Barium/Zinc Stabilizer | 4.6 |
| Epoxy Soya Oil | 7 |
| Mineral Spirits | 3 |
| Texanol Isobutyrate | 1.7 |
| Glycol Butyrate Benzoate | 32 |

Foamable Chip Stock

| | Parts By Weight |
|---|---|
| PVC Homopolymer Dispersion Resin, RV = 3.0 | 56 |
| PVC Homopolymer Dispersion Resin, RV = 1.90 | 44 |
| Glycol Benzoate Butyrate | 44 |
| Mineral Spirits | 5 |
| Zinc Oxide/Cadmium Oxide Stabilizer Catalyst | 0.5 |
| Azodicarbonamide | 2.5 |
| Titanium Dioxide | 7.5 |
| Expoxy Soya Oil | 6.0 |

In general the particle employed in this invention can have a wide variety of geometric shapes. Exemplary of other geometric shapes are squares, triangles, circles, annuli, other polygons, etc., or irregular sizes and shapes, or a mixture of any or all of such shapes, including spheroidal. The method of preparation of the decorative resinous particles or the specific formulation thereof is not critical to the practice of this invention. Any particles conventionally employed in making inlaid floor and wall covering products can be used.

6. The Embedding/Gelling/Smoothing Step

This step is essential to the invention since it has been discovered that the above discussed advantages are dependent upon this step.

The coated substrate sheet (ie. coated with a gelled plastisol, optionally printed as shown in FIG. 1, and then coated with a wet, ungelled adhesive layer to which resinous particles have been applied), in the preferred manner of carrying out this step, is gradually and uniformly brought into contact with a cylindrical surface, normally a heated cylinder which is at a temperature of between about 250° F. and about 400° F. and, preferably, between about 270° F. and about 350° F., so that the surface coated with the ungelled plastisol and resinous particulates contacts the cylindrical surface which, in an especially preferred embodiment is a heated, rotating chrome drum.

The substrate is brought into contact with the cylindrical surface by means of a dimensional stable, reinforced silicone or TEFLON belt which is under tension so that it stretches around a part of the circumference of the cylindrical surface in contact therewith. The substrate, as it passes between the belt and the cylindrical surface, is maintained in contact with the cylindrical surface by the application of the force which tensions the belt.

The sequence in which the substrate contacts the cylindrical surface and the belt is not critical. However, where the substrate contacts the cylindrical surface first, contact with the belt should be made before the gellation temperature of the ungelled plastisol is reached. Such belts contact usually must occur within about two seconds of contact with the cylindrical surface.

In accordance with geometric principles, the resultant normal force causing flow of the ungelled plastisol up around the resinous particles and against the cylindrical surface increases according to a sinusoidal function from 0 to a maximum which occurs at the midpoint between the two points of contact between the belt and the cylindrical surface. This gradual increase in force results in gradual, even flow of plastisol around the resinous particles to contact the cylindrical surface without the formation of a rolling bank normally present when a nip roller is used to apply pressure. The prior art practice of using a nip roll normally results in the redistribution of the resinous particles in an undesirable pattern known in the art as "tracking".

Although other means for gradually and uniformly increasing the contact pressure between the cylindrical surface and the surface of the coated substrate can be employed to produce a normal force in accordance with the geometric principles herein discussed, it has been found particularly effective to use a dimensionally stable belt of the type discussed above.

By controlling the volume of the ungelled plastisol, the temperature of the cylindrical surface, the loading of the resinous particles and the line speed, there is obtained an embedded/gelled/smooth matrix, wherein the embedded particles are encapsulated by the plastisol (and, in the preferred case, just or barely encapsulated). The other advantages achieved by this step have already been discussed and will not be repeated here.

The resultant, consolidated matrix leaving the embedding/gelling/smoothing step is gelled firm and, also, has a surface suitable for further processing and finishing, as desired or required.

7. Further Processing Step(s)

While the gelled, consolidated matrix is smooth, the matrix may contain some air entrapped in the interstices between the resinous particles. This is more likely to be the case when irregularly shaped particles are employed than when spheroidal particles are used. It, therefor, becomes optionally beneficial to apply a thin, uniform plastisol coating to the surface and gel it, against a hot cylinder, eg. a hot chrome drum, to prevent any entrapped air from escaping into the topcoat upon final fusion. This smoothcoat can then be applied by any means conventionally used to apply such thin, uniform coatings, as, for example, by a reverse roll coater, knife coater or the like. The thickness of this coat normally ranges from about 2 to about 15 mils, preferably from about 2 to about 10 mils.

The resultant wet, ungelled smoothcoat is brought into contact with a hot cylinder, preferably, a hot chrome drum, by means of a nip roll which causes the formation of a rolling bank which effectively fills any depressions and results in a surface which mirrors the surface of the cylinder. The time the coating is in contact with the cylinder is normally 2–25 seconds, depending on the thickness and formulation, after which the coating is firmly gelled and can be removed from contact with the cylinder. Other means can be employed to smooth and gel the top coat, but the forgoing has been found effective in commercial practice.

The gelled, smoothcoated matrix may be printed, if so desired, using the same or similar methods, inks and equipment described before.

The gelled, smoothcoated (optionally printed) matrix can then be optionally coated with one or more wearlayers of plastisol and/or polyurethane. Such coatings are conventionally applied using, for example, the coating apparatus and methods previously described. The wearlayers of this invention normally range from about 3 to about 25 mils and preferably from about 5 to about 10 mils. When a urethane wearlayer is employed the thickness ranges from about 1 to about 5 mils. The wet, ungelled, coated (i.e. smooth coated) matrix is then gelled and fused until fusion of the wear layer occurs and decomposition of any blowing or foaming agent that may be present is achieved. This generally requires temperatures between about 300° F. to about 450° F. and, preferably, between about 350° F. to about 410° F., for about 1–7 minutes in a hot air recirculating or IR oven operated at these temperatures.

The decomposition of the blowing or foaming agent with attendant foaming can occur in the substrate coating, and/or the adhesive coating, and/or some or all of the resinous particles themselves, and may be selectively suppressed by the inclusion of a suitable chemical agent in the printing ink composition applied to certain areas of the desired printed pattern or design to inhibit or suppress any blowing or foaming agent which may be present. The temperature, time and heat transfer coefficient are interdependent and the higher the temperature or heat transfer coefficient the shorter the time and vice versa.

In accordance with the process of this invention a final product is produced which is ready for trimming, cutting and packaging, alternatively, the product can be rewound in large rolls and stored pending further operations to be performed at a later date.

The following examples more fully demonstrate the principles and practice of the process of this invention. In these examples, unless otherwise stated, all parts and percentages are by weight.

EXAMPLE 1

Residential Floorcovering with Registered and Embossed Patterns (Chemically Embossed)

A floorcovering substrate sheet of conventional type non-asbestos felt (Tarkett Inc., Whitehall, Pa.) approximately 32 mils thick is coated with 8 mils of a foamable plastisol the composition of which is as follows:

| | Parts by Weight |
|---|---|
| PVC dispersion: k value 65 (Occidental FPC 605) | 70 |
| PVC extender resin: k value 60 (PLIOVIC M-5) | 30 |
| Di(2-ethylhexyl) phthlate | 28 |
| Butyl benzyl phthlate | 15 |
| Texanol isobutyrate (TXIB) | 15 |
| Titanium dioxide | 10 |
| Azodicarbonamide | 2.5 |
| Kerosene | 4 |
| Zinc oxide | 1.5 |
| Viscosity: | 2500 cps |

The coated substrate is then gelled in a hot oven at 275° F. for 2.0 minutes. The surface is then printed on a multi-head gravure press using SERIES 125 inks from American Inks, Inc.. The ink used to print the valley areas of the pattern (i.e. the grouts) contains additionally 140 parts benzotriazole, a chemical suppressant, to inhibit in these selected areas the expansion of the foamable plastisol.

After printing, an adhesive layer about 10 mils thick, is applied using a reverse roll coater. The wet coated sheet is then passed under a vibrating pan feeder (SYNTRON vibratory feeder manufactured by FMC Corp.) where 0.36 lb/yd$^2$ of premixed plastisol pearl particles (50/50 colored/transparent) are uniformly deposited on the surface.

The composition of the adhesive mix is:

| | Parts by Weight |
|---|---|
| PVC dispersion: relative viscosity 2.05 (Occidental FPC 6458) | 70 |
| PVC extender: k value 60 (PLIOVIC M-50) | 30 |
| Butyl benzyl phthlate | 25 |
| Di-isononyl phthlate | 25 |
| Stabilizer, barium-zinc type (SYNPRON 1665) | 4 |

The composition of the pearl particles is:

| Parts by Weight | Colored | Transparent |
|---|---|---|
| Suspension grade PVC resin: k value 65 (PEVIKON S658 GK) | 100 | 100 |
| Butyl benzyl phthalate | 40 | 40 |
| Stabilizer, barium-zinc type (SYNPRON 1665) | 4 | 4 |
| Titanium dioxide | 5 | — |
| Color-pigment (Purchased blend of red iron oxide, yellow iron oxide and carbon black dispersed in | 5 | — |

-continued

| Parts by Weight | Colored | Trans-parent |
|---|---|---|
| di(2-ethyl-hexyl) phthalate) | | |

The PEVIKON S658 GK resin has an aspect ratio of about 1 (the particles are round) and the particle size is found by microscopic observation to average about 600 microns (approximately 30 mesh). Screen analysis is as follows:

| Mesh | % Retained |
|---|---|
| 28 (589 microns) | 68.0 |
| 65 (208 microns) | 25.2 |
| 100 (147 microns) | 1.4 |
| Thru 100 mesh | 5.4 |

The substrate, coated with ungelled adhesive plastisol and premixed plastisol pearls, is then compacted, smoothed and gelled by contacting the coated side against a heated chrome drum, having a diameter of 2 meters, at 350° F. and applying a gradually increasing normal force with a reinforced silicone belt maintained at a tension of 15 pli for a period of 12 seconds.

The surface of the matrix containing the embedded pearls, which is smoothed and firm, is then coated, using a reverse roll coater, with 5 mils of a transparent plastisol having the following composition:

| | Parts by Weight |
|---|---|
| Dispersion grade PVC, relative viscosity 2.05 (Occidental FPC 6458) | 100 |
| Isobutyric acid and glycol ester of benzoic acid (NUOPLAZ 1538, Tenneco Chemical Inc.) | 56 |
| Stabilizer, barium-zinc type (SYNPRON 1665) | 5 |
| Epoxidized soybean oil | 5 |
| Kerosene | 2 |
| Brookfield Viscosity: ~1200 cps | |

The wet, ungelled coating is further smoothed and gelled by contacting the coated side against a heated chrome drum at 300°-320° F. using a floating rubber nip roller and sufficient pressure to create a rolling bank in the nip. The material is maintained in contact with the drum for 10 seconds to insure complete gellation.

Approximately 5 mils of additional wearlayer having the same composition as the smoothcoat is then applied using a reverse roll coater. The wet, coated product is then fused and expanded in a recirculating hot air oven for 4.5 minutes. The temperature profile is 390°/400°/390°/390° F. in the successive zones.

The floorcovering product thereby produced displays a relief structure (embossing) in register with the printed areas. The decorative inlaid product has an overall thickness of about 82 mils and exhibits excellent wear and design characteristics.

EXAMPLE 2

Floor covering with Overall Pattern Suitable For Commercial Uses

A floorcovering substrate sheet of conventional type non-asbestos felt (Tarkett Inc., Whitehall, Pa.) approximately 32 mils thick is coated with 8 mils of a foamable plastisol the composition of which is as follows:

| | Parts by Weight |
|---|---|
| PVC emulsion: RV = 2.05 (Occidental FPC 605) | 70 |
| PVC extender resin: k value 60 (PLIOVIC M-50) | 30 |
| Di(2-ethylhexyl) phthlate | 30 |
| Butyl benzyl phthlate | 30 |
| Titanium dioxide | 5 |
| Crystalline calcium carbonate | 80 |
| Barium-zinc type stabilizer (IRGASTAB BZ 530) | 3 |

The wet coating is smoothed and gelled by contacting the coated side against a heated chrome drum at 300° F., with a floating rubber nip roller and sufficient pressure to create a rolling bank at the nip. The material is maintained in contact with the drum for 7 seconds.

The resulting smooth surface is then printed on a multi-head gravure press using SERIES 125 inks from American Inks, Inc..

After printing, an adhesive layer about 10 mils thick is applied using a reverse roll coater. The wet coated sheet is then passed under a vibrating pan feeder (SYNTRON vibratory feeder manufactured by FMC Corp.) where 0.36 lb/yd$^2$ of premixed plastisol pearl particles (50/50 colored/transparent) are uniformly deposited on the surface.

The composition of the adhesive mix is:

| | Parts by Weight |
|---|---|
| PVC dispersion: relative viscosity 2.05 (Occidental FPC 6458) | 70 |
| PVC extender: k value 60 (PLIOVIC M-50) | 30 |
| Butyl benzyl phthlate | 25 |
| Di-isononyl phthlate | 25 |
| Stabilizer, barium-zinc type (SYNPRON 1665) | 4 |

The composition of the pearl particles is:

| Parts by Weight | Colored | Trans-parent |
|---|---|---|
| Suspension grade PVC resin: k value 65 (PEVIKON S658 GK) | 100 | 100 |
| Butyl benzyl phthalate | 40 | 40 |
| Stabilizer, barium-zinc type (SYNPRON 1665) | 4 | 4 |
| Titanium dioxide | 5 | — |
| Color-pigment (Purchased blend of red oxide, yellow oxide and carbon black dispersed in di(2-ethyl-hexyl) phthalate) | 5 | — |

The PEVIKON S658 GK resin has an aspect ratio of about 1 (the particles are round) and the particle size is found by microscopic observation to average about 600 microns (approximately 30 mesh). Screen analysis is as follows:

| Mesh | % Retained |
|---|---|
| 28 (589 microns) | 68.0 |
| 65 (208 microns) | 25.2 |
| 100 (147 microns) | 1.4 |
| Thru 100 mesh | 5.4 |

The substrate, coated with ungelled adhesive plastisol and premixed plastisol pearls, is then compacted, smoothed and gelled by contacting the coated side against a heated chrome drum, having a diameter of 2 meters, at 350° F. and applying a gradually increasing normal force with a reinforced silicone belt maintained at a tension of 15 pli for a period of 12 seconds.

The resultant smooth and firm surface of the matrix containing the embedded pearls is then coated, using a reverse roll coater, with 5 mils of a transparent plastisol having the following composition:

| | Parts by Weight |
|---|---|
| Dispersion grade PVC, relative viscosity 2.05 (Occidental FPC 6458) | 100 |
| Isobutyric acid and glycol ester of benzoic acid (NUOPLAZ 1538, Tenneco Chemicals Inc.) | 56 |
| Stabilizer, barium-zinc type (SYNPRON 1665) | 5 |
| Epoxidized soybean oil | 5 |
| Kerosene | 2 |
| Brookfield Viscosity: | ~1200 cps |

The wet ungelled coating is further smoothed and gelled by contacting the coated side against a heated chrome drum at 300°–320° F. using a floating rubber nip roller and sufficient pressure to create a rolling bank in the nip. The material is maintained in contact with the drum for 10 seconds to insure complete gellation. The gelled, coated product is then fused in a recirculating hot air oven for 4.5 minutes. The temperature profile is 390°/400°/390°/390° F. in the successive zones.

The floor covering thereby produced exhibits excellent design and wear characteristics.

EXAMPLE 3

Residential Floorcovering Containing Overprinted Chips

A non-woven glass mat flooring substrate (FG-7180, Manville Corporation, Denver, Colorado) is coated-/impregnated on a reverse roll coater with a filled plastisol the composition of which is as follows:

| | Parts by Weight |
|---|---|
| PVC Homopolymer Dispersion Resin, RV = 2.9 | 100 |
| Butyl benzyl phthlate | 30 |
| Texanol isobutyrate (TXIB) | 17 |
| Linear Alkyl Benzene | 8 |
| Aliphatic Hydrocarbon | 2 |
| Calcium Carbonate | 100 |
| Barium/Zinc Stabilizer | 3 |

The wet, ungelled coating is further smoothed and gelled by contacting the coated side against a heated chrome drum at 300°–320° F. using a floating rubber nip roller and sufficient pressure to create a rolling bank in the nip. The material is maintained in contact with the drum for 10 seconds to insure complete gellation.

After coating/impregnating and sealing the glass substrate, an adhesive layer about 15 mils thick, is applied using a reverse roll coater.

The composition of the adhesive mix is:

| | Parts by Weight |
|---|---|
| PVC/PVAc 0.5% Copolymer Dispersion Resin, RV = 2.4 | 70 |
| PVC Homopolymer Suspension Resin, RV = 1.90 | 30 |
| Glycol Butyrate Benzoate | 63 |

-continued

| | Parts by Weight |
|---|---|
| Texanol Isobutyrate | 1.75 |
| Barium/Zinc Stabilizer | 4.6 |
| Epoxy Soya Oil | 4.6 |

The wet, coated sheet is then passed under a vibrating pan feeder (SYNTRON vibratory feeder manufactured by FMC Corp.) where approximately 0.4 lb/yd$^2$ of blended, ground, gelled plastisol chips are uniformly deposited on the surface.

The chip blend contains both non-foamable, ie. solid, chips and foamable chips made of the following compositions:

Solid Chip Stock

| | Parts by Weight |
|---|---|
| PVC Homopolymer Dispersion Resin, RV = 3.0 | 55 |
| PVC Homopolymer Suspension Resin, RV = 1.90 | 44 |
| Barium/Zinc Stabilizer | 4.6 |
| Epoxy Soya Oil | 7 |
| Mineral Spirits | 5 |
| Texanol Isobutyrate (TXIB) | 1.7 |
| Glycol Butyrate Benzoate | 32 |

Foamable Chip Stock

| | Parts by Weight |
|---|---|
| PVC Homopolymer Dispersion Resin, RV = 2.05 | 56 |
| PVC Homopolymer Suspension Resin, RV = 1.90 | 44 |
| Glycol Butyrate Benzoate | 44 |
| Mineral Spirits | 5 |
| Zinc Oxide/Cadmium oxide Stabilizer Catalyst | 0.5 |
| Azodicarbonamide | 2.5 |
| Titanium Dioxide | 7.5 |
| Epoxy Soya Oil | 6 |

The chip compositions are coated on release paper at a thickness of 7 mils and gelled in a recirculating air oven at 300° F. for 5 minutes. The gelled plastisol sheets are then stripped from the release paper and ground in a 4G18-MX grinder manufactured by Ball & Jewel. The resultant chips are then screened to remove those larger than 12 mesh and those smaller than 30 mesh.

The substrate, coated with ungelled adhesive plastisol and blended, gelled plastisol chips, is then compacted, smoothed and gelled by contacting the coated side against a heated chrome drum, having a diameter of 2 meters, at 320° F. and applying the gradually increasing normal force with a reinforced silicone belt maintained at a tension of 15 pli for a period of 12 seconds. A uniformly gelled matrix layer is produced, having a smooth and firm surface of uniform thickness.

The surface of the matrix containing the embedded chips is then coated on a knurled roll coater with 2 mils of a transparent plastisol having the following composition:

| | Parts by Weight |
|---|---|
| PVC Homopolymer Dispersion Resin, RV = 3.0 | 54 |
| PVC Homopolymer Suspension Resin, RV = 1.90 | 46 |
| Glycol Butyrate Benzoate | 32 |
| Calcium/Zinc Stabilizer | 5.4 |

-continued

| | Parts by Weight |
|---|---|
| Epoxy Soya Oil | 5.4 |
| Mineral Spirits | 2.7 |

The wet, ungelled coating is further smoothed and gelled by contacting the the coated side against a heated chrome drum at 320° F. using a floating rubber nip roller and sufficient pressure to create a rolling bank in the nip. The material is maintained in contact with the drum for 2.5 seconds to insure complete gellation.

The resulting smooth surface is then printed with transluscent inks having the composition set forth in Example 1. At least some of these inks contain, additionally, the chemical suppressant of Example 1 to inhibit the expansion of the foamable plastisol in selected areas.

Using a reverse roll coater, approximately 10 mils of a plastisol wear layer, having the following composition, is then applied to the printed plastisol coat:

| | Parts by Weight |
|---|---|
| PVC Homopolymer Dispersion Resin, RV = 2.3 | 100 |
| Glycol Butyrate Benzoate | 28 |
| Texanol Isobutyrate | 12 |
| Barium/Zinc Stabilizer | 4.6 |
| Epoxy Soya Oil | 4.6 |
| Mineral Spirits | 4 |
| Polymeric Polyester Plasticizer | 12 |

The wet, coated product is then fused and expanded in a recirculating hot air oven for 4.5 minutes with a temperature profile of 390°/400°/390°/300° F. in the successive zones.

The final step involves applying a mechanically frothed foam to the back of the substrate to encapsulate glass fibers and provide a cushion for the product upon installation. This foam is frothed on a typical frothing machine (such as Oaks or Texacote), applied under a stationary knife coater and fused in a hot air oven at temperatures between about 300° F. and about 325° F. for 3 to 5 minutes. The foam composition is:

| | Parts by Weight |
|---|---|
| PVC/PVAc 0.5% Copolymer Dispersion Resin, RV = 2.5 | 59 |
| PVC Homopolymer Suspension Resin, RV = 1.90 | 41 |
| Di-isononyl Phthlate | 34 |
| Dihexyl phthalate | 14.5 |
| Texanol Isobutyrate | 12 |
| Barium/Zinc Stabilizer | 1 |
| Mineral Spirits | 5 |
| Calcium Carbonate | 14 |
| Titanium Dioxide | 2.3 |
| Silicone Surfactant | 4 |

The floorcovering product thereby produced exhibits a relief structure (embossing) in register with the printed areas and a particularly appealing inlaid appearance.

In carrying out the process of this invention to produce real through-patterned inlaids, it has been found that unique design advantages and superior final product properties, such as wear resistance, can be achieved when resinous particles are used which have an aspect ratio significantly lower than those currently employed in inlaids commercially offered in the United States and a particle size, preferably falling within the range of from about 0.004 inch to about 0.040 inch. In general the particles employed in this embodiment have an aspect ratio of no greater than about 2:1 and, preferably, no greater than about 1.5:1. Particles having an aspect ratio of about 1:1 and, in particular, spheroidal particles, are especially preferred because of the excellent results achieved therewith. The use of particles which are essentially as thick as they are flat, ie. having a low aspect ratio, provides a product that will not lose its pattern due to wear in use, thus preserving the unique property which characterizes true inlaids.

The use of printed patterns which are visible beneath the adhesive matrix containing the particles broadens the options available to the pattern designer. Exemplary is a decorative, inlaid floor or wall covering which comprises:

(a) a substrate, (b) a printed layer, generally comprising a printable substrate coating or sealant, onto which is printed a pattern in an ink suitable for floor or wall covering applications, applied over and in contact with said substrate, and (c) an adhesive matrix, overlaying said printed layer, and in contact therewith, in which are embedded the resinous particles, said matrix being sufficiently transparent or transluscent to permit the underprint to show through.

Such product provides options for a wide variety of design strategies heretofore unobtainable with state-of-the-art sheet vinyl technology.

Thus another embodiment of this invention is the production of such a product by a process which comprises:

(a) to a substrate, (b) applying a printed layer, generally comprising a printable substrate coating or sealant, onto which is printed a pattern in an ink suitable for floor or wall covering applications, applied over and in contact with said substrate, and (c) applying an adhesive matrix, overlaying said printed layer, in contact therewith, in which the resinous particles are embedded/gelled/smoothed in one step, as described hereinabove, eg. Step 6 of FIG. 1, said matrix being sufficiently transparent or transluscent to permit the underprint to show through.

The inlaid products produced by the use of such resinous particles in accordance with the process of this invention offer unique design advantages. Further, cost advantages can also be realized by utilizing raw materials which are believed to be unique to inlaid manufacture. For example, certain of the products which are produced in accordance with the process of this invention incorporate an adhesive matrix consisting essentially of a plastisol layer containing a high loading of transparent and/or transluscent and colored, spheroidal resinous particles, which, preferably, range in size from about 0.004 inches to about 0.040 inches. When this matrix is applied over a printed pattern, a unique visual effect is produced.

Such particles can be made in uniform controlled sizes by employing technology described in U.S. Pat. No. 3,856,900, the entire contents of which are incorporated herein by reference. Alternatively, special large particle size dry blend resinous particles, either screened to the desired size ranges of this invention from oversized material obtained from normal production variations, or specially made particles in the desired size range, can be utilized.

Another, and preferred, embodiment of this invention is a process for producing a decorative, inlaid floor covering which comprises:

(a) to a non-asbestos felt sheet substrate,
(b) applying and gelling a printable, plastisol coating over said substrate,
(c) applying one or more solvent based PVC-polyvinyl acetate copolymer inks to the surface of the gelled plastisol layer,
(d) applying a wet, ungelled adhesive matrix, overlaying said plastisol/print layer, and in contact therewith, containing an effective amount of a homopolymer or a copolymer of vinyl chloride,
(e) depositing to the wet ungelled adhesive matrix discreet spherical and essentially spherical, gelled and resinous particles, at least some of which permit the underprint to show through, and wherein said particles are coarse PVC homopolymer or copolymer polymerization agglomerates, sized to between about 0.004–0.060 (preferably less than 0.040) inches,
(f) embedding/gelling/smoothing the adhesive matrix in accordance with the process of this invention, and, optionally,
(g) applying and fusing a transparent, plastisol wearlayer as a top coat.

As mentioned, the size of the particles employed in carrying out this invention have a pronounced effect on the results obtained. Use of relatively small particles, eg. ranging from about 150 microns (100 mesh) to about 600 microns (30 mesh) are most advantageous in producing the desired design effects. Particles, especially spheroidal particles, averaging about 600 microns (by microscopic observation) are especially preferred.

The ratio of transparent to colored particles determines the visibility of the printed pattern underneath the resulting adhesive matrix. Generally, 50% or less, and preferably 0–30%, transparent to colored particle loading is preferred. The amount actually used will, of course, depend upon the type of end-use application and design effect desired. Good results have even been achieved in the range of 0–10% transparent to colored particle loading.

The optional overcoat or wearlayer is preferably a plastisol of the same or similar type as that discussed above in connection with the resins employed in the substrate coat and the adhesive layer or matrix. The formulations generally include materials to enhance special specific properties, for example gloss, wear, stain resistance, and scuff resistance.

Other resins suitable for use as a top coating can be employed. Exemplary are wear resistant polyurethanes, such as those described in U.S. Pat. No. 4,087,400.

Thus, another product which can be produced by the process of this invention is a decorative, inlaid floor or wall covering which comprises:

(a) a flexible mat substrate,
(b) a gelled, resinous print layer, applied over said substrate, the surface of which is printed with one or more inks suitable for use in the manufacture of floor or wall covering products, and
(c) an adhesive matrix, overlaying said print layer, containing an effective amount of a homopolymer or a copolymer of vinyl chloride, and in which are embedded resinous particles, at least some of which permit the underprint to show through, and
(d) an optional topcoating or wearlayer or wearlayers selected from the group consisting of a plastisol, a polyurethane resin or a suitable mixture of each.

For certain markets, such as residential, the wear characteristics are secondary to the visual impact of the design. Certain particularly pleasing design effects also may be achieved by utilizing chip type decorative particles (having chemical compositions as discussed hereinabove) where the decorative particles are characterized by one dimension being significantly smaller than the other two. For example, chips may range from 30 to 250 mils in the two larger dimensions and from 2 to 15 mils in thickness. Visual impressions created by such particles may be, under certain circumstances, more suited to overprinting with transparent, transluscent or even opaque inks if the opaque inks are restricted to a low area coverage, to achieve certain desirable design effects. The process of this invention is uniquely suited for orienting particles of this shape into the two dimensional plane of an ungelled resinous coating without causing "tracking". Thus, another and preferred embodiment of this invention is a process for producing a decorative, inlaid floor or wall covering which comprises:

(a) a substrate,
(b) an adhesive matrix, applied to and in contact with said substrate, in which are embedded the decorative particles,
(c) a printed layer, generally comprising a pattern and an ink suitable for floor or wall covering applications, applied over and in contact with said matrix and being sufficiently open, transluscent or transparent to allow the decorative particles to show through, and
(d) a transparent or transluscent wearlayer.

Typical of a process for making such product is a method for producing a decorative inlaid floor or wall covering which comprises:

(a) to a substrate,
(b) applying a wet, ungelled adhesive matrix, in contact with said matrix,
(c) depositing decorative particles to said adhesive matrix, wherein said particles have the dimensions last described above,
(e) embedding/gelling/smoothing the adhesive matrix in accordance with the process of this invention, e.g. Step 6 of FIG. 1,
(d) then applying a printed layer, generally comprising a pattern, in an an ink suitable for floor or wall covering applications, in contact with said matrix and being sufficiently open, transluscent or transparent to allow the decorative particles to show through, and
(e) applying over said printed layer a transparent or transluscent wearlayer.

Although the forgoing discussion describes this invention in terms of floor or wall covering products, this invention is intended to encompass any covering including, but not necessarily limited to, floor or wall covering, which can be produced in accordance with the process herein described. Also, while the invention has been described with respect to certain embodiments thereof, it will be apparent to those skilled in the art that various changes and modifications may be made without departing from the spirit and scope of the invention.

What is claimed is:

1. In a method for making decorative inlaid types of sheet materials, which comprises forming a plastic layer of wet ungelled PVC plastisol or organosol on a sheet of flexible substrate and depositing resinous particles on said plastic layer, the improvement which comprises then passing the sheet between a heated, cylindrical surface and a means for gradually and uniformly increasing the contact pressure between the cylindrical surface and the coated surface of the sheet facing the cylindrical surface, at a temperature sufficient to gell the plastisol, so that, upon completion of the operation, an inlaid sheet material is produced which has the particles embedded in a gelled top layer having a smooth and firm outer surface.

2. The method of claim 1 wherein said inlaid sheet material thus produced is, optionally, coated, printed or coated and printed.

3. The method of claim 1 wherein the gelled matrix has a surface suitable for accepting a smooth coat, printing or a wear layer.

4. The method of claim 1 wherein the resinous particles are encapsulated in the gelled plastisol.

5. The method of claim 1 wherein the coated surface of the sheet is maintained in contact with the cylindrical surface until the coating is firmly gelled.

6. The method of claim 1 wherein said cylindrical surface is a drum and said means is a heat resistant, dimensionally stable belt under tension and surrounding part of the circumferance of said drum so that the tension applied to the belt is gradually translated into pressure on said sheet as it moves over the surface of said drum.

7. The method of claim 6 wherein said belt is under a substantially constant tension.

8. The method of claim 6 wherein said tension is between about 5 and about 50 pounds per lineal inch.

9. The method of claim 8 wherein said tension is between about 10 and about 25 pounds per lineal inch.

10. The method of claim 8 wherein the time the coating on said sheet is in contact with said drum is between about 5 and about 25 seconds.

11. The method of claim 9 wherein the time the coating on said sheet is in contact with said drum is between about 10 and about 18 seconds.

12. The method of claim 6 wherein the coated surface of the sheet is maintained in contact with the drum until the temperature substantially throughout the plastic layer is increased to the point of gellation.

13. The method of claim 1 wherein said cylindrical surface is a heated, rotating chrome drum.

14. The method of claim 1 wherein said means is a heat resistant, dimensionally stable, silicone or TEFLON belt.

15. In a method of making decorative inlaid types of sheet materials, which comprises forming a plastic layer of wet, ungelled PVC plastisol or organosol on a sheet of flexible substrate and depositing resinous particles on said plastic layer, the improvement which comprises then passing the sheet between a heated cylinder and a heat resistant, dimensionally stable belt under tension and surrounding part of the circumferance of said cylinder so that the tension applied to the belt is gradually translated into pressure on said sheet as the coated surface of the sheet moves over the surface of said drum, in contact therewith, at a line speed and temperature sufficient to gell the plastisol, so that, upon completion of the operation, an inlaid sheet material is produced which has the particles embedded in a gelled top layer having a smooth and firm outer surface.

16. In a method for making decorative inlaid types of sheet materials, which comprises forming a plastic layer of wet, ungelled PVC plastisol or organosol on a sheet of flexible substrate and depositing resinous particles on said plastic layer, the improvement which comprises passing the sheet between a first and a second curved surface, the second encircling at least a part of the circumference of the first, in contact therewith and moving in the general direction thereof, while applying a normal force to said plastic which increases, in accordance with a sinusoidal function, from 0 to a maximum occurring essentially at the midpoint between the two points of contact between the two surfaces, at a line speed and temperature sufficient to gell the plastisol, so that, upon completion of the operation, an inlaid sheet material is produced which has the particles embedded in a gelled top layer having a smooth and firm outer surface.

17. The process of claim 16 wherein said second curved surface is a flexible strap-like member under tension.

* * * * *